US006927542B2

(12) United States Patent
Liedenbaum et al.

(10) Patent No.: US 6,927,542 B2
(45) Date of Patent: Aug. 9, 2005

(54) METHOD OF DRIVING AN ORGANIC ELECTROLUMINESCENT DISPLAY DEVICE AND DISPLAY DEVICE SUITABLE FOR SAID METHOD

(75) Inventors: Coen Theodorus Hubertus Fransiscus Liedenbaum, Eindhoven (NL); Adrianus Sempel, Eindhoven (NL); Remco Los, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/477,490

(22) PCT Filed: May 15, 2002

(86) PCT No.: PCT/IB02/01682

§ 371 (c)(1),
(2), (4) Date: Nov. 12, 2003

(87) PCT Pub. No.: WO02/093537

PCT Pub. Date: Nov. 21, 2002

(65) Prior Publication Data

US 2004/0164937 A1 Aug. 26, 2004

(30) Foreign Application Priority Data

May 15, 2001 (EP) ..... 01201809

(51) Int. Cl.[7] ..... G09G 3/10

(52) U.S. Cl. ..... 315/169.3; 315/169.1

(58) Field of Search ..... 315/169.1, 169.3; 345/45, 76–77, 55, 60; 313/505, 306–307

(56) References Cited

U.S. PATENT DOCUMENTS 5,525,867 A * 6/1996 Williams ..... 315/169.3
5,821,690 A * 10/1998 Martens et al. ..... 313/506
6,014,119 A * 1/2000 Staring et al. ..... 345/82
6,191,764 B1 * 2/2001 Kono et al. ..... 345/76
6,437,769 B1 * 8/2002 Kobayashi et al. ..... 345/102
2001/0030507 A1 * 10/2001 Ono ..... 313/504

* cited by examiner

*Primary Examiner*—Thuy V. Tran

(57) ABSTRACT

A display has a light-emitting layer, such as a light-emitting polymer or a small molecule compound layer, sandwiched between two electrodes structures including an anode structure having a plurality of subgroups of separated anode segments. Each mode segment in each anode subgroup is surrounded by anode segments that are not members of the same anode subgroup. Essentially each anode segment is a member of the anode subgroups. A signal selector assembly is connected to each anode segment, and is arranged to provide the anode segments of a single anode subgroup with image information signals, while holding the remaining anode segments at equal potentials.

12 Claims, 2 Drawing Sheets

METHOD OF DRIVING AN ORGANIC ELECTROLUMINESCENT DISPLAY DEVICE AND DISPLAY DEVICE SUITABLE FOR SAID METHOD

The present invention relates to a method of driving a display device comprising a layer of organic electroluminescent material, such as a light-emitting polymer or a small molecule compound.

The invention also relates to a display device comprising a light-emitting layer, such as a light-emitting polymer or a small molecule compound layer, sandwiched between a first and a second electrode structure, said device being suitable for use in the method described above.

The polymer light-emitting diode, or polyLED technology, is a fairly recently discovered technology, which is based on the fact that certain polymers may be used as semiconductors in light emitting diodes. This technology is very interesting because polymers are light, flexible materials and inexpensive to produce. Consequently, polyLEDs provide the opportunity to create thin and highly flexible displays, for example for use as electronic newspapers or the like. Further applications of polyLED displays may be, for example, displays for cellular telephones.

PolyLED displays have a plurality of advantageous features over competing technologies, such as LCD displays. To start with, polyLED displays are very efficient in generating light, and the luminous intensity may be more than 3 times higher for a polyLED display than an LCD display. Consequently, the polyLED display can be run three times longer on one and the same battery. Moreover, the polyLED has benefits regarding contrast and brightness. For example, polyLED displays are not dependent on the viewing angle, because light is transmitted with the same intensity in all directions.

However, as stated above, the polyLED displays belong to a fairly recent field of technology, and consequently, there is a need to improve these displays.

The basic device structure of a polymer LED display comprises a structured electrode or anode, commonly of ITO, a cathode and two layers, a conductive layer such as a conductive polymer layer (for example, PEDOT) and an emissive layer, both layers being sandwiched between the anode and the cathode. The polymer LED display may further utilize different driving means. Two alternatives are passive matrix driving and active matrix driving and the invention mainly relates to these types of matrix displays.

In a passive matrix display, the anode may comprise a set of separate parallel anode strips, also referred to as anode columns (or anode rows depending on their direction), each being connected to a current source. In this case, the cathode may also comprise a set of separate parallel cathode strips, also referred to as cathode rows (or cathode columns depending on their direction), their direction being essentially perpendicular to the anode strips or columns. A passive matrix device may be driven in a "one line at a time" mode, i.e. a set of different currents in accordance with a desired pixel pattern is applied to said set of anode columns, and a corresponding cathode row is activated in such a way that the whole current is collected in this row. The result is that, for a specific cathode row the pixels, created by the crossing anodes and cathodes, light up with a luminous intensity which is dependent on the amount of current that has been fed to the anode column during the time when the cathode row has been activated (also referred to as line time) and consequently has been led through the light-emitting polymer layer. After the line time has elapsed, the currents according to the next desired pixel pattern are fed to the set of anode columns, and the next cathode row in the sequence is activated to collect the current. By repeating this method for all cathode row strips in the set, a complete image is created. Usually, this process is repeated 25 to 200 times a second (the so-called frame rate) in order to obtain a visually stable image.

In active matrix displays, the screen is divided into a plurality of separate pixel cells, each having a separate transistor for driving the cell and each having a separate pixel anode. An example of such a display is disclosed in patent publication JP-10 074 759.

However, a problem with these kinds of displays is the occurrence of leakage currents between neighbouring anode segments, such as anode columns or pixel anodes. This phenomenon is also referred to as crosstalk. In accordance with the prior art, when it is desired to display an image on the display screen, a signal is sent to each pixel in order to establish a desired electric field across the pixel cell, thereby generating a desired light emission as a current passes the light-emitting polymer. However, this has the effect that a certain pixel may be surrounded by neighbouring pixels which are subjected to an electric field of a different magnitude, due to desired variations in the image. Consequently, due to potential differences between neighbouring anodes, leakage currents will occur between said anodes. This leakage results in an unwanted degradation of the picture quality and a decreased sharpness of the image, and this is schematically shown in FIG. 3. To a certain degree, this kind of leakage may be compensated for by predicting the sizes and directions of the leakage current and the electric fields across the pixel cells may be adjusted accordingly. However, this kind of compensation may become very complicated, because the surrounding cells are individually fed. This leads to the fact that the leakage current is dependent on the direction of the display, i.e. the leakage current may be very small in one direction and large in another direction. Consequently, there is a need for a simple, more effective way of dealing with said leakage currents.

It is an object of the present invention to provide a display device and a method of driving a display device, overcoming the problems described above.

These and other objects are achieved by a method of driving a display device as described in the opening paragraph, wherein said layer is sandwiched between an anode and a cathode, said anode comprising a plurality of separated anode segments, the method comprising the steps of:

dividing the anode segments of said display device into N subgroups, each anode segment in each subgroup being surrounded by anode segments which are not members of the same subgroup, essentially each anode segment of the display device being a member of one of said subgroups, dividing an image signal, comprising all information necessary to display a full picture on said display, into corresponding N subgroups, so that the i:th subgroup comprises the information intended to be fed to the anode segments of the corresponding i:th anode segment subgroup, $1 \leqq i \leqq N$, and during a first time period $t_1$, feeding a first subgroup (i=1) of said image signal to a corresponding first subgroup of first anode segments, meanwhile holding all other anode segments, having $i \neq 1$ and surrounding an anode segment belonging to said first subgroup at essentially equal potentials.

By feeding each anode segment belonging to a certain group, while holding the surrounding segments at a constant potential, the potential gap between each fed anode segment and the surrounding segments will be constant. The leakage currents between the fed anode segment and the surrounding segments will thus be equal in all directions, making it easier to predict and compensate.

In accordance with a preferred embodiment of the invention, the method further comprises the steps of subsequently feeding, during subsequent time periods $t_1, t_2 \ldots t_N$, the i:th image signal subgroup to the i:th anode segment subgroup, until each anode subgroup has been activated, and repeating the above for a subsequent image signal frame. In this way, every pixel of the display may be used to build up an image that may be visibly seen, while gaining the advantages of having the neighbouring anodes of a fed anode at constant potentials during the entire image generation phase.

Moreover, the step of holding all other anode segments, having $i \neq 1$ and surrounding an anode segment belonging to said first subgroup at an essentially constant and equal potential suitably comprises the step of connecting this group of anode segments to ground, which is an easy way of providing a constant potential to the surrounding cells.

In accordance with an embodiment of the invention, said display device is a passive matrix display device comprising column anodes and row cathodes, wherein said column anodes constitute said anode segment, whereby leakage currents between neighbouring row anodes are avoided. The passive matrix display device in accordance with the invention is preferably constituted by two subgroups of interspersed column anodes, i.e. N=2. By having two interspersed groups, the most effective coverage of the display is accomplished, resulting in a comparatively low repetition rate. It goes without saying that this invention is independent of the direction of the cathodes and anodes, respectively. Consequently, the terms column anode and row cathode should be understood to comprise row anodes and column cathodes as well as any other angular configuration.

In accordance with a second embodiment of the invention, said display device is an active matrix display device having a separated anode segment for each pixel, essentially each pixel being totally surrounded by a plurality of neighbouring pixels.

Consequently, this kind of display may be driven in a semi-continuous mode where, for instance, an image signal could be fed to every fifth pixel of the display, whereas the neighbouring pixels are connected to a constant potential, such as ground, and thereby acts as a guard ring for that specific pixel. In the next step, the subsequent set of pixels is addressed and this process may be repeated five times per frame period, in order to illuminate every pixel of the display.

The above-stated and other objects are also achieved by a display device comprising a light-emitting polymer layer being sandwiched between a first and a second electrode structure, and is characterized in that said first electrode structure, constituting an anode structure, comprises a plurality of separated anode segments which are divided into N subgroups, said subgroups being such that each anode segment in each subgroup is surrounded by anode segments which are not members of the same subgroup, essentially each anode segment of the display device being a member of one of said subgroups, wherein said display device further comprises a signal selector assembly which is connected to each anode segment, said signal selector assembly being arranged to provide the anode segments of a single subgroup with image information signals, while holding the remaining anode segments at equal potentials. By feeding each anode segment belonging to a certain group, while holding the surrounding segments at a constant potential, the potential gap between each fed anode segment and the surrounding segments will be constant. The leakage currents between the fed anode segment and the surrounding segments will thus be equal in all directions, making it easier to predict and compensate, and there will be no unwanted variations in the pixel intensity. It should be noted that, in a preferred embodiment, the light-emitting polymer layer comprises an organic electroluminescent material.

An image signal frame $IS_{tot}$, comprising all information necessary to display a full picture on said display, is preferably arranged to be fed to said signal selector assembly and divided into N image signal subgroups $IS_1, IS_2, \ldots IS_N$, corresponding to said N anode segment subgroups, wherein, during subsequent time periods $t_1, t_2 \ldots t_N$, the i:th image signal subgroup $IS_i$ is arranged to be fed to the i:th anode segment subgroup, until each anode subgroup has been activated, whereafter the above is repeated for a subsequent image signal frame $IS_{tot_next}$. In this way, every pixel of the display may be used to build up an image that may be visibly seen, while gaining the advantages of having the neighbouring anodes of a fed anode at constant potentials during the entire image generation phase. In order to maintain a constant updating rate, compared with state of the art devices, the frame rate for $IS_i$ must be N times higher, in order to provide the same updating rate for $IS_{tot_next}$. Suitably, said signal selector assembly is arranged to provide the anode segments of a single subgroup with image information signals, while connecting the remaining anode segments to ground, which is an easy way of providing a constant and equal potential to the surrounding cells.

In accordance with a preferred embodiment, said display is a passive matrix display device comprising column anodes and row cathodes, wherein said column anodes constitute said anode segment, whereby leakage currents between neighbouring row anodes are avoided. The passive matrix display device in accordance with the invention is preferably constituted by two subgroups of interspersed column anodes, i.e. N=2. By having two interspersed groups, the most effective coverage of the display is accomplished, resulting in a comparatively low repetition rate. It goes without saying that this invention is independent of the direction of the cathodes and anodes, respectively. Consequently, the terms column anode and row cathode should be understood to comprise row anodes and column cathodes as well as any other angular configuration.

In accordance with a second embodiment of the invention, said display device is an active matrix display device having a separated anode segment for each pixel, essentially each pixel being totally surrounded by a plurality of neighbouring pixels.

Consequently, this kind of display may be driven in a semi-continuous mode where, for instance, an image signal could be fed to every fifth pixel of the display, whereas the neighbouring pixels are connected to a constant and equal potential, such as ground, and thereby acts as a guard ring for that specific pixel. In the next step, the subsequent set of pixels is addressed and this process may be repeated five times per frame period, in order to illuminate every pixel of the display.

A currently preferred embodiment of the present invention will now be described in greater detail, with reference to the accompanying drawings.

Figure 1:
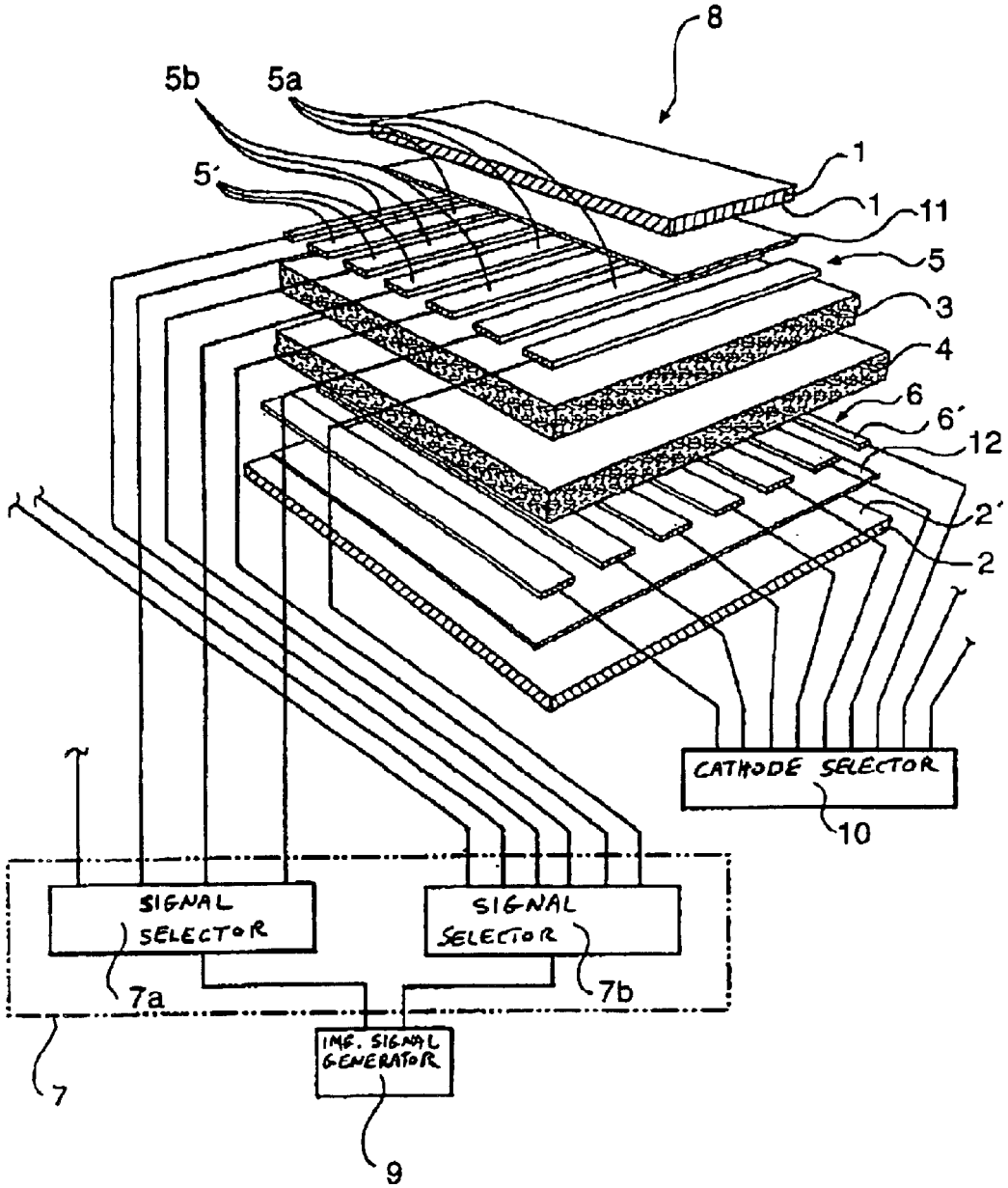
FIG. 1 is a schematic drawing showing the inventive display structure as well as connected control devices.
Figure 2:
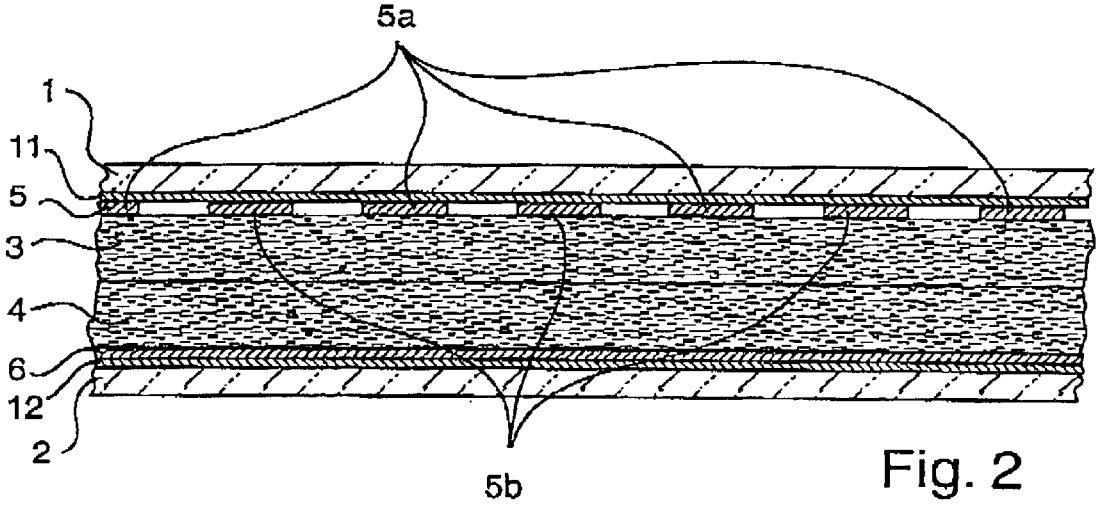
FIG. 2 is a schematic cross-section of a display device as shown in FIG. 1.
Figure 3:
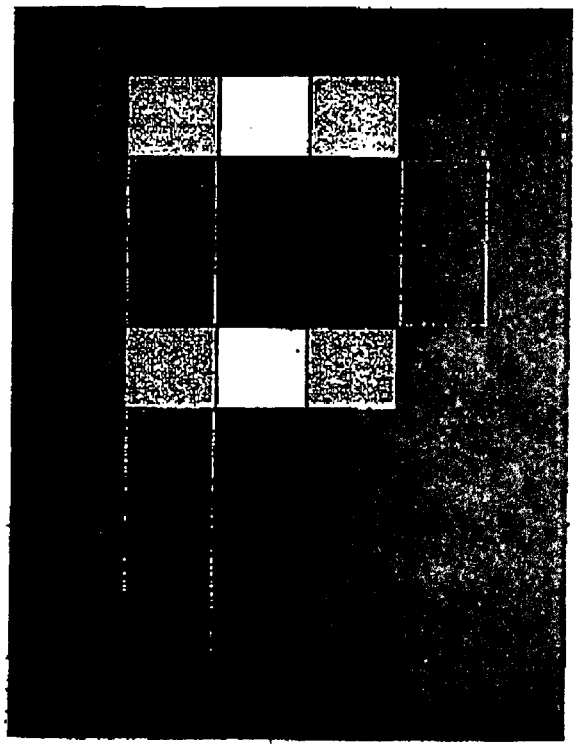
PRIOR ART Fig. 3
FIG. 3 is a schematic drawing illustrating the problem with prior art devices.

FIG. 1 and FIG. 2 are schematic drawings showing a display device structure 8 in accordance with the invention. The device 8 essentially comprises a first and a second substrate plate 1, 2 and a polymer layer 3, 4, sandwiched between said substrate plates 1, 2, as best seen in FIG. 2. The inner surface 1' of the first substrate, i.e. the surface facing the polymer layer is provided with an electrode structure 5 forming a large number of separated, mutually parallel columns, each constituting an anode or anode segment 5' in said display device 8. The display device 8 has L anode segments 5'. Each anode segment 5' is connected to an image signal generator 9 as described in greater detail below. In the same manner, the inner surface 2' of the second substrate 2, i.e. the surface facing the polymer layer is provided with a second electrode structure 6, forming a large number of separated and mutually parallel rows, each constituting a cathode or cathode segment 6' in said display device 8. The display device 8 has M cathode segments 6'. Each cathode is connected to a cathode selector 10 so as to select which cathode should be activated at what time. In FIG. 1, said cathode rows 6' and anode columns 5' are essentially perpendicular to each other as seen from above, together creating a pattern of pixels. Protective layers 11 and 12, which are electrically and chemically insulating layers, are arranged between the electrode structures 5 and the substrate plate 1 and the second electrode structure 6 and the substrate plate 2, respectively.

The polymer layer 3,4 is constituted by two sub-layers, a first conductive layer 3, in this case a polymer layer such as a PEDOT-layer, and a second emissive layer 4, the first conductive layer 3 being placed proximate to the anode structure 5 and the second emissive layer 4 being placed closer to the cathode structure 6.

As mentioned above, each anode column 6' is connected to an image signal generator 9 which is arranged to feed a current to each anode segment 6', the magnitude of said current being dependent on the desired image that is to be generated on said display 8. Furthermore, said image signal generator 9 comprises a signal selector assembly 7, as will be further described closer hereinafter.

In the present case, as shown in FIG. 1 with a passive matrix display, the anode segments 5' are divided into two subgroups, each subgroup comprising every other anode segment of the display. Consequently, a first group 5*a* and a second group 5*b* of interspersed anode segments 5' are generated. Every anode segment of the first group 5*a* is connected to a first signal selector unit 7*a*, and every anode segment of the second group 5*b* is connected to a second signal selector unit 7*b*. Together, said first and second selector units 7*a*, 7*b* form a signal selector assembly 7 which is connected to the said image signal generator 9.

Each cathode segment is connected to a cathode selection device 10 having the function of choosing which cathode should be active during a specific time frame based on information from the image signal generator regarding the image information that is currently to be displayed.

The present passive matrix device is driven in a "one line at a time" mode, i.e. a set of different currents in accordance with a desired pixel pattern is applied to said set of anode columns, and a corresponding cathode row is activated in such a way that the whole current is collected in this row. When driving and thereby generating an image on the display, an image signal $IS_{tot}$, comprising all information which is necessary to display a full and complete image throughout the display is first generated in said image signal generator (or is received from another source, as is the case in, for example, a television display). This signal is subsequently split into L segments (L being the total number of anode segments of the display), one for each anode segment of the display. Every crossing between an anode and a cathode may be referred to as a pixel of said display, while each L signal segment consequently comprises all information needed to drive one column of pixels in order to create a full image, together with other pixel columns. However, since said display 8 is driven in a "one line at a time" mode, or more correctly in this case a "one row at a time" mode, said L signal segments comprise information for driving the first row during a time period 0-T, the second row during a time period T-2T and so on. The time T is sometimes referred to as line time.

Furthermore, the L signal segments are divided into N subgroups each corresponding to one of the anode segment groups. In a general case, the signal segments are divided into N subgroups, $IS_1$, $IS_2$ . . . $IS_N$, corresponding to said anode segment groups $\mathbf{5}_1$, $\mathbf{5}_2$ . . . $\mathbf{5}_N$. The signal subgroups $IS_1$-$IS_N$ are subsequently fed to a signal selector assembly 7 which is arranged to forward a first signal subgroup $IS_1$ to the first anode segment subgroup $\mathbf{5}_1$ during a first time period $t_1$, while the remaining subgroups are held at a constant potential, such as ground potential. Preferably, $t_1$ has a duration between 0-T/N, and the next time interval has an equal length, T/N ($T=t_1+t_2+ \ldots t_N$). During the second time interval $t_2$ in the sequence, the signal selector assembly 7 is arranged to forward a second signal subgroup $IS_2$ to the second anode segment subgroup $\mathbf{5}_2$, while the remaining subgroups are held at a constant potential, such as ground potential. The above is repeated for $t_3$, $t_4$ . . . $t_N$ until every pixel of the display, belonging to one of these subgroups has been activated.

In the specific case (shown), N=2, and the signal segments are consequently divided into 2 subgroups, IS1 and IS2, corresponding to the anode segment groups 5*a* and 5*b*, respectively. The signal subgroups IS1 and IS2 are then fed to signal selector assemblies 7*a* and 7*b*, respectively. The first signal selector 7*a* is arranged to forward the first signal subgroup IS1 to the first anode segment subgroup 5*a* during the first half of each time line, i.e. during 0-T/2. During the second time interval T/2-T, the first signal selector 7*a* is arranged to feed a constant potential, such as ground potential, to the first anode segment subgroup 5*a*. During the same line time, the second signal selector 7*b* is arranged to feed a constant potential, such as ground potential, to the second anode segment subgroup 5*b* during the first half of each line time, i.e. during 0-T/2. During the second time interval T/2-T, the second signal selector 7*b* is arranged to forward the second signal subgroup IS2 to the second anode segment subgroup 5*b*. Consequently, every other anode segment is fed with a control signal during the first part of the cathode row activation time, while the remaining ones are held at equal potential, and the opposite applies during the second part of the cathode row activation time. The result is that, for a specific cathode row, the pixels, created by the crossing anodes and cathodes, light up with a luminous intensity which is dependent on the amount of current that has been fed to the anode column during the time when the cathode row has been activated (also referred to as line time) and consequently has been led through the light-emitting polymer layer.

Subsequently, the next cathode row in the sequence is activated to collect the current, and the currents according to the next desired pixel pattern are first fed to the first set of anode columns and then to the second set of anode columns.

The above-described process is repeated for all rows of the display. The whole process is repeated 25 to 200 times/second (referred to as frame rate) in order to obtain a stable image.

By driving the display in the manner described above, every driven pixel is always surrounded by pixels, at the time being connected to ground (or some other equal and constant potential). Unwanted variations and fluctuations of pixel intensity, due to variations of the magnitudes of the leakage currents, are thus avoided. Furthermore, when utilising the above-described driving method and display, one is not dependent on the exact value of the specific resistance of the PEDOT-material used in one of the polymer layers as described above.

It goes without saying that many variations of the embodiment described above, especially regarding the signal division and the feeding order, are possible, and such modifications are within the scope of the appended claims. Furthermore, the time division may be changed, which is of special importance for colour displays. In the embodiment described above, either the frame rate has to be doubled or the line time has to be halved, since the image for each row is built up in two steps. The approach described above may also be implemented if one does not address the even and odd columns during the first and the second half of the line time, but during subsequent frames. The terms columns and rows shall be interpreted in broad terms, since the mutual direction of the anodes and cathodes are irrelevant for the invention.

In accordance with a second embodiment of this invention, the driving and display technology described above is implemented for matrix colour displays. In this case, the same basic principle holds, as described above. However, one needs to provide for correct translation of video information into pixel addressing, but this is not of any real importance for the inventive features as described above, and will therefore not be further described.

In accordance with a third embodiment of the invention, the display device is an active matrix device having a separate transistor for driving each cell. This kind of display has the advantage over passive matrix displays in that the current that triggers pixel illumination may be smaller, resulting in quicker switching. However, in this case, the power leakage, causing picture degradation, occurs in two directions, because all pixels that surround the pixel to be activated determine the leakage current. In the present case, the display may be driven in a semi-continuos mode where, for example, every fifth pixel in the array lights up, whereas each of the lit pixels is surrounded by pixels connected to earth, together forming a guarding ring for that specific frame. In the next step, the subsequent set of pixels is addressed and in this case this process is repeated five times, until each set of pixels of the display has been lit.

The present invention should not be considered as being limited to the embodiment described above, but rather includes all possible variations within the scope defined by the appended claims. Examples of such variations are described above. Further variations of the invention may include the use of several smaller display structures, as displayed above, using separate control means and jointly covering a larger display area.

It should be further noted that, although the embodiment described above relates to a display using light-emitting polymers, the invention, as described in the appended claims, is equally applicable to displays using other organic electroluminescent materials, such as small molecule compounds.

What is claimed is:

1. A method of driving a display device having a layer of organic electroluminescent material, such as a light-emitting polymer or a small molecule compound, said layer being sandwiched between an anode and a cathode, said anode comprising a plurality of separated anode segments, the method comprising:

dividing the anode segments of said display device into a plurality of anode subgroups, each anode segment in each anode subgroup being surrounded by anode segments that are not members of the same anode subgroup, essentially each anode segment of the display device being a member of one of said anode subgroups;

dividing an image signal, comprising all information necessary to display a full and complete picture on said display, into a plurality of image signal subgroups corresponding in number to the plurality of anode subgroups, such that each image signal subgroup of the plurality of image signal subgroups comprises the information intended to be fed to the anode segments of a respective anode subgroup; and during a first time period, feeding a first image signal subgroup of said image signal subgroups to a corresponding first anode subgroup of the plurality of anode subgroups while holding all anode segments, not belonging to said first anode subgroup and surrounding any anode segment belonging to said first anode subgroup at essentially equal potentials.

2. The method of claim 1, including:

sequentially feeding, during subsequent time periods, successive ones of the image signal subgroups to respective ones of the anode subgroups, while holding all anode segments surrounding any anode segment belonging to the anode subgroup being fed at essentially equal potentials, until each anode subgroup has been activated, and repeating said sequential feedings for a subsequent image signal frame.

3. The method of claim 1, wherein the step of holding all anode segments not belonging to said first anode subgroup and surrounding any anode segment belonging to said first anode subgroup at essentially equal potentials comprises the step of connecting all anode segments not belonging to said first anode subgroup to ground.

4. The method of claim 1, wherein said display device is a passive matrix display device comprising column anodes and row cathodes, wherein said column anodes comprise said anode segments.

5. The method of claim 4, wherein there are exactly two anode subgroups and two image signal subgroups.

6. The method of claim 1, wherein said display device is an active matrix display device having a separated anode segment for each pixel, essentially each pixel being totally surrounded by a plurality of neighbouring pixels.

7. A display device comprising a light-emitting layer, such as a light-emitting polymer or a small molecule compound layer, sandwiched between a first and a second electrode structure, wherein said first electrode structure, constituting an anode structure, comprises a plurality of separated anode segments that are divided into a plurality of anode subgroups, said anode subgroups being such that each anode segment in each anode subgroup is surrounded by anode segments that are not members of the same anode subgroup, essentially each anode segment of the display device being a member of one of said anode subgroups, wherein said display device further comprises a signal selector assembly connected to each anode segment, said signal selector assembly being arranged to provide the anode segments of a single anode subgroup with image information signals, while holding the remaining anode segments at equal potentials.

8. The device of claim 7, wherein an image signal frame, comprising all information necessary to display a full picture on said display, is arranged to be fed to said signal selector assembly and divided into a plurality of image signal subgroups, corresponding to said anode subgroups, wherein, during each of a number of subsequent time periods a respective signal subgroup of said image signal subgroups is arranged to be fed to a respective anode segment subgroup, until each anode subgroup has been activated, whereafter the above is repeated for a subsequent image signal frame.

9. The device of claim 7, wherein said signal selector assembly is arranged to provide the anode segments of a single anode subgroup with image information signals, while connecting the remaining anode segments to ground.

10. The device of claim 7, wherein said display is a passive matrix display device comprising column anodes and row cathodes, wherein said column anodes comprise said anode segments.

11. The device of claim 10, wherein there are exactly two anode subgroups and two image signal.

12. The device of claim 7, wherein said display device is an active matrix display device having a separated anode segment for each pixel, essentially each pixel being totally surrounded by a plurality of neighbouring pixels.

* * * * *